United States Patent [19]

Pfizenmaier et al.

[11] Patent Number: 4,643,095

[45] Date of Patent: Feb. 17, 1987

[54] PRINTING UNIT CYLINDER FOR ROTARY OFFSET PRINTING MACHINES AND METHOD OF PRODUCTION

[75] Inventors: Wolfgang Pfizenmaier, Neckargemünd; Hans-Jürgen Beck, Heidelberg, both of Fed. Rep. of Germany

[73] Assignee: Heidelberger Druckmaschinen AG, Heidelberg, Fed. Rep. of Germany

[21] Appl. No.: 801,476

[22] Filed: Nov. 25, 1985

[30] Foreign Application Priority Data

Nov. 23, 1984 [DE] Fed. Rep. of Germany ... 8434353[U]

[51] Int. Cl.[4] ..... B41F 13/08

[52] U.S. Cl. ..... 101/401.1; 101/375

[58] Field of Search ..... 101/216, 375, 376, 348, 101/401.1, 395, 426, 217, 142, 137

[56] References Cited

U.S. PATENT DOCUMENTS 2,114,072 4/1938 Cleveland ..... 101/216

FOREIGN PATENT DOCUMENTS 1009507 5/1977 Canada ..... 101/348

*Primary Examiner*—J. Reed Fisher

*Attorney, Agent, or Firm*—Herbert L. Lerner; Laurence A. Greenberg

[57] ABSTRACT

A printing unit cylinder of a given diameter for offset rotary printing machines having a galvanically applied wear and corrosion-resistant jacket surface coating, comprising a cylinder body formed with a cylinder channel and having a transitional surface from a cylindrical jacket surface thereof to the cylinder channel, the cylindrical jacket surface and the transitional surface having a sand-blasted surface roughness of 10 to 20 microns, a nickel undercoating having a hardness of 180 to 220 Vickers hardness disposed on the cylindrical jacket surface and the transitional surface; and a chromium layer disposed on the undercoating and having a hardness of greater than 900 Vickers hardness and a microcracked surface of greater than 400 cracks per $cm^2$, the cylinder body having a diameter less than the given diameter of the printing unit cylinder by a thickness corresponding to the superimposed thicknesses of the nickel chromium and the chromium layer.

2 Claims, 1 Drawing Figure

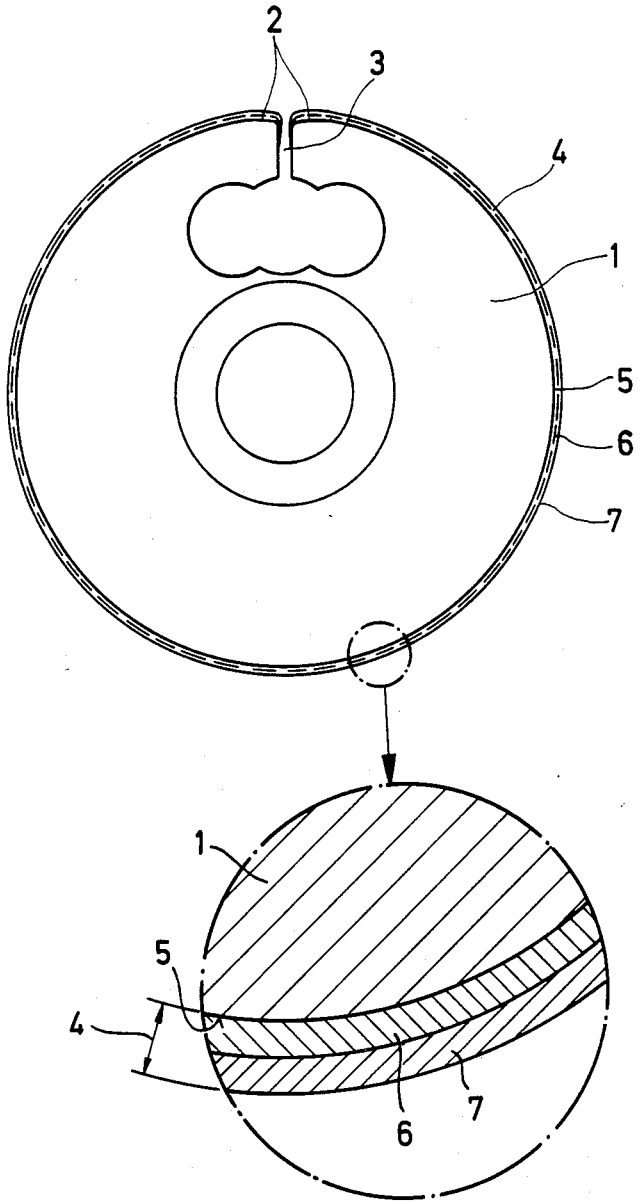
2
3
4
1
5
6
7
1
5
4
6
7

PRINTING UNIT CYLINDER FOR ROTARY OFFSET PRINTING MACHINES AND METHOD OF PRODUCTION

The invention relates to a printing unit cylinder for rotary offset printing machines and a method of production thereof, the printing unit cylinder being of the type which has a galvanically applied wear and corrosion-resistant jacket surface coating thereon.

Such coatings of printing unit cylinders which are produced by a galvanic or electro-deposition process are generally known and serve primarily for protecting the surface of the cylinder from corrosion. A layer of chromium is normally used for this purpose, it being ground to precise dimensions and shape after being applied. A disadvantage of the conventional construction are the great manufacturing expenses and consequently the high costs, without being able to attain, for example, a desired surface structure of the chromium layer. Furthermore, when the transitional areas at the surface of the cylinder located in vicinity of the cylinder channel are ground, a visible edge is formed which can cause disturbances when the cylinder rolls on another cylinder of similar construction.

It is accordingly an object of the invention to provide a printing unit cylinder which has a cylindrical surface provided with a coating requiring no subsequent mechanical machining or other processing, has a high resistance to corrosion and reduces impact at the cylinder channel by means of a smooth transition, and a method of producing such a printing unit cylinder.

With the foregoing and other objects in view, there is provided, in accordance with the invention, a printing unit cylinder of a given diameter for offset rotary printing machines having a galvanically applied wear and corrosion-resistant jacket surface coating, comprising a cylinder body formed with a cylinder channel and having a transitional surface from a cylindrical jacket surface thereof to said cylinder channel, said cylindrical jacket surface and said transitional surface having a sand-blasted surface roughness of 10 to 20 microns, a nickel undercoating having a hardness of 180 to 220 HV (Vickers hardness) disposed on said cylindrical jacket surface and said transitional surface; and a chromium layer disposed on said nickel undercoating and having a hardness of >900 HV (greater than 900 Vickers hardness) and a microcracked surface of >400 cracks per $cm^2$, the cylinder body having a diameter less than the given diameter of the printing unit cylinder by a thickness corresponding to the superimposed thicknesses of the nickel undercoating and the chromium layer.

In accordance with another aspect of the invention, there is provided a method of producing a printing unit cylinder of a given diameter for offset rotary printing machines having a galvanically applied wear and corrosion-resistant jacket surface coating, which comprises forming a cylinder body with a cylinder channel and with a transitional surface from a cylindrical jacket surface thereof to the cylinder channel, sand-blasting the cylindrical jacket surface and the transitional surface to a surface roughness of 10 to 20 microns, then applying a nickel undercoating having a hardness of 180 to 220 HV to the cylindrical jacket surface and the transitional surface, and, thereafter, superimposing on the nickel undercoating a layer of chromium having a hardness of >900 HV and a microcracked surface of >400 cracks per $cm^2$, the diameter of the cylinder body and the thicknesses of the nickel undercoating and the chromium layer corresponding to the given diameter.

Other features which are considered as characteristic for the invention are set forth in the appended claims.

Although the invention is illustrated and described herein as embodied in a printing unit cylinder for offset rotary printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing which is a diagrammatic end view of a printing unit cylinder constructed in accordance with the invention.

Referring now to the FIGURE of the drawing, there is shown therein a printing unit cylinder 1 having a cylindrical peripheral surface portion over most of a jacket surface 5 thereof but also having respective transition surface portions 2 adjacent a cylinder channel 3 formed in the cylinder 1. A coating 4 is provided on the jacket surface 5 and is formed of a nickel layer 6 as an undercoating and a chromium layer 7 superimposed thereon as a top coating. The jacket surface 5 of the cylinder 1, is initially sand-blasted to a surface roughness of 10 to 20 microns, and is then galvanically or electrolytically coated with the nickel and the chromium successively. The nickel undercoating which is formed has a hardness of 180 to 220 HV, whereas the chromium layer superimposed thereon has a hardness of >900 HV and a microcracked surface of >400 cracks per $cm^2$. The uncoated body of the cylinder is of such diameter and the two applied coatings or layers of nickel and chromium, respectively, are of such thickness that the finished dimensions of the printing unit cylinder 1 requires no subsequent machining. Furthermore, the coatings on the transition surface portions 2 on the jacket surface 5 of the cylinder 1 at the cylinder channel 3 are formed without any visible edge.

Additional advantages of the printing unit cylinder produced in accordance with the invention are that it offers a high resistance to corrosion by means of a coating which is resistant to impact and, while one such cylinder rolls on another, a smooth transition is assured as the cylinder channel passes. Moreover, the structure of the surface of the cylinder jacket prevents slippage of the plate underlayer or support without impairing the good possibility for cleaning the cylinder jacket.

The foregoing is a description corresponding in substance to German application No. G 84 34 353.2, filed Nov. 23, 1984, the International priority of which is being claimed for the instant application, and which is hereby made a part of this application. Any material discrepancies between the foregoing specification and the aforementioned corresponding German application are to be resolved in favor of the latter.

What is claimed are:

1. Printing unit cylinder of a given diameter for offset rotary printing machines having a galvanically applied wear and corrosion-resistant jacket surface coating, comprising a cylinder body formed with a cylinder channel and having a transitional surface from a cylindrical jacket surface thereof to said cylinder channel, said cylindrical jacket surface and said transitional surface having a sand-blasted surface roughness of 10 to 20 microns, a nickel undercoating having a hardness of 180 to 220 vickers hardness disposed on said cylindrical jacket surface and said transitional surface; and a chromium layer disposed on said undercoating and having a hardness of greater than 900 vickers hardness and a microcracked surface of greater than 400 cracks per $cm^2$, said cylinder body having a diameter less than the given diameter of the printing unit cylinder by a thickness corresponding to the superimposed thicknesses of said nickel undercoating and said chromium layer.

2. Method of producing a printing unit cylinder of a given diameter for offset rotary printing machines having a galvanically applied wear and corrosion-resistant jacket surface coating, which comprises forming a cylinder body with a cylinder channel and with a transitional surface from a cylindrical jacket surface thereof to the cylinder channel, sand-blasting the cylindrical jacket surface and the transitional surface to a surface roughness of 10 to 20 microns, then applying a nickel undercoating having a hardness of 180 to 220 vickers hardness to the cylindrical jacket surface and the transitional surface, and, thereafter, superimposing on the nickel undercoating a layer of chromium having a hardness of greater than 900 vickers hardness and a microcracked surface of greater than 400 cracks per $cm^2$, the diameter of the cylindrical body and the thicknesses of the nickel undercoating and the chromium layer corresponding to the given diameter.

* * * * *